US006152719A

United States Patent [19]

Nelik et al.

[11] Patent Number: 6,152,719

[45] Date of Patent: Nov. 28, 2000

[54] GEAR PUMP HAVING AN INLET PORT ALIGNED WITH THE DRIVE SHAFT

[75] Inventors: Lev A. Nelik, Athens; William Chadwick Garrish, Alto; Laney Albert Seabolt, Commerce, all of Ga.

[73] Assignee: Roper Pump Company, Commerce, Ga.

[21] Appl. No.: 08/933,283

[22] Filed: Sep. 18, 1997

[51] Int. Cl.[7] ..... F04C 2/16; F04C 15/00

[52] U.S. Cl. ..... 418/201.1

[58] Field of Search ..... 418/201.1, 206.1, 418/206.4, 206.7

[56] References Cited

U.S. PATENT DOCUMENTS

| | | | |
|---|---|---|---|
| 32,133 | 4/1861 | Hall . | |
| D. 223,040 | 2/1972 | Otto . | |
| D. 229,236 | 11/1973 | Doolin . | |
| D. 246,976 | 1/1978 | Bell et al. . | |
| 1,751,703 | 3/1930 | Long | 418/201.1 |
| 1,762,708 | 6/1930 | Allred | 418/201.1 |
| 1,923,268 | 8/1933 | Jensen | 418/206.1 |
| 3,077,839 | 2/1963 | Gondek | 418/206.1 |
| 3,831,906 | 8/1974 | Wakeman | 418/206.1 |
| 4,553,915 | 11/1985 | Eley | 418/206.7 |
| 4,995,892 | 2/1991 | Garrett et al. | 65/12 |

FOREIGN PATENT DOCUMENTS

| | | | |
|---|---|---|---|
| 1657745 | 6/1991 | Russian Federation | 418/206 |

OTHER PUBLICATIONS

Roper Catalog: "Roper Pumps Series A", Bulletin A—Sep. 1994.

Roper Catalog: "3600–3700/4600–4700 Heavy Duty Pump", Bulletin 7025 revised Sep. 1994.

*Primary Examiner*—John J. Vrablik
*Attorney, Agent, or Firm*—Alston & Bird LLP

[57] ABSTRACT

The present invention overcomes deficiencies in the prior art by providing a centrifugal pump which conforms to ANSI standards, is reversible, is efficient, is self priming, has low flow stability and low radial thrust characteristics, handles viscous fluids well, and can pump fluid within a high range of pressure values. Such a pump configuration provides an easy way to retrofit problem applications, an attractive cost effective solution for the new installations, and ensures dimensional interchangeability of the pump, for ease of replacement, spare parts inventory, and standardization of maintenance techniques

16 Claims, 7 Drawing Sheets

GEAR PUMP HAVING AN INLET PORT ALIGNED WITH THE DRIVE SHAFT

TECHNICAL FIELD

This invention relates in general to pumps, and particularly relates to a gear pump which conforms to ANSI pump standards for centrifugal pumps yet includes features not ordinarily provided by centrifugal pumps.

BACKGROUND OF THE INVENTION

Pumps, including liquid pumps, have been well known in the industry for years. Generally described, such pumps typically include a mechanical input such as an input shaft, which accepts energy and transfer it to fluid within the pump to cause the fluid to move through the pump from its inlet to its outlet port and further on to a remote location.

Many types of fluid pumps have been developed throughout the industry. Such pumps include rotary pumps (such as lobe, external/internal gear, progressing cavity, etc.) piston pumps, and centrifugal pumps.

As noted above, pumps typically have an inlet and an outlet port, as well as a mechanical power input. As can be understood, there are multiple locations and orientations where such ports and power inputs can be placed during the design of such pumps. As engineering preferences tend to carry by designer, this gives rise to a tendency for different pump manufacturers to develop their own differing designs. This can provide difficulties to end users, not the least being difficulties in replacing pumps of manufacturers which have discontinued the pump model or have gone out of business.

The above-discussed disadvantages have given rise the use of various standards, including ANSI standards. To conform to such standards, manufacturers must provide products which conform to certain dimensional or structural standards. For example, an ANSI standard for a 1 HP electrical motor might specify the output shaft size and length as well as the height of the shaft relative to the lower surface of mounting feet. This would allow and engineer or like designer to design a system including a 1 HP electrical motor with such dimensions in mind without regard to which manufacturer will be used to supply the motor. The purpose of the ANSI standard pump is to ensure dimensional interchangeability of the pump, for ease of replacement, spare parts inventory, and standardization of maintenance techniques. ANSI specifications can include inlet flow location, outlet flow location, rear foot location, drive shaft location, front feet location drive shaft diameter, port sizes and foot hole sizes.

In the fluid pump industry, the ANSI specification has traditionally been applied to centrifugal pumps, allowing easy retrofitting of these dimensionally interchangeable pumps from one pump manufacturer to another. However, rotary pumps have traditionally been produced without the compliance to ANSI dimensional standards, even though they are used for a wide variety applications.

Although centrifugal pumps are presently afforded the advantage of an ANSI specification, they nevertheless have their own disadvantages. For example, centrifugal pumps only can pump in one direction; to allow for bidirectional pumping two centrifugal pumps must be used—one for loading and another for unloading, which necessitates the use of complex piping, valving, and auxiliaries. For centrifugal pumps, a change in fluid properties can also result in a definite change in performance. Centrifugal pumps also cannot provide an effective metering function. Centrifugal pumps are likewise plagued by problems relating to low flow instability, susceptibility to inlet piping, low efficiency, high radial thrust, leading to low MTBF and premature failures of seals, bearings and other components.

Aside from the need of standards, in the past several years, the issues of pump reliability, maintenance, dependability and cost have found a renewed focus. With the industry drive toward inventory reduction and simplification of operation, it is becoming increasingly important for pump manufacturers to supply pumps having ability to fit as wide range of applications as possible, without compromising reliability and dependability.

Therefore there is a need in the industry for a rotary pump which conforms to ANSI standards yet is reversible, is efficient, is self priming, has low flow stability, low radial thrust characteristics, handles viscous fluids well, and can pump fluid within a high range of pressure values.

SUMMARY OF THE INVENTION

The present invention overcomes deficiencies in the prior art by providing a centrifugal pump which conforms to ANSI standards, is reversible, has low flow stability, is efficient, is self priming, has low flow stability, low radial thrust characteristics, handles viscous fluids well, and can pump fluid within a high range of pressure values. Such a pump configuration provides an easy way to retrofit problem applications, an attractive cost effective solution for the new installations, and ensures dimensional interchangeability of the pump, for ease of replacement, spare parts inventory, and standardization of maintenance techniques.

Therefore it is an object of the present invention to provide a gear pump which satisfies ANSI centrifugal pump specifications.

It is a further object of the present invention to provide a pump which satisfies ANSI centrifugal pump specifications but is reversible.

It is a further object of the present invention to provide a pump which satisfies ANSI centrifugal pump specifications but is efficient.

It is a further object of the present invention to provide a pump which satisfies ANSI centrifugal pump specifications but has improved low flow characteristics.

It is a further object of the present invention to provide a pump which satisfies ANSI centrifugal pump specifications but can handle viscous fluids.

It is a further object of the present invention to provide a pump which satisfies ANSI centrifugal pump specifications but can pump at high pressures.

It is a further object of the present invention to provide a pump which satisfies ANSI centrifugal pump specifications but can accommodate a variety of fluid pressures.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Outline

Figure 1:
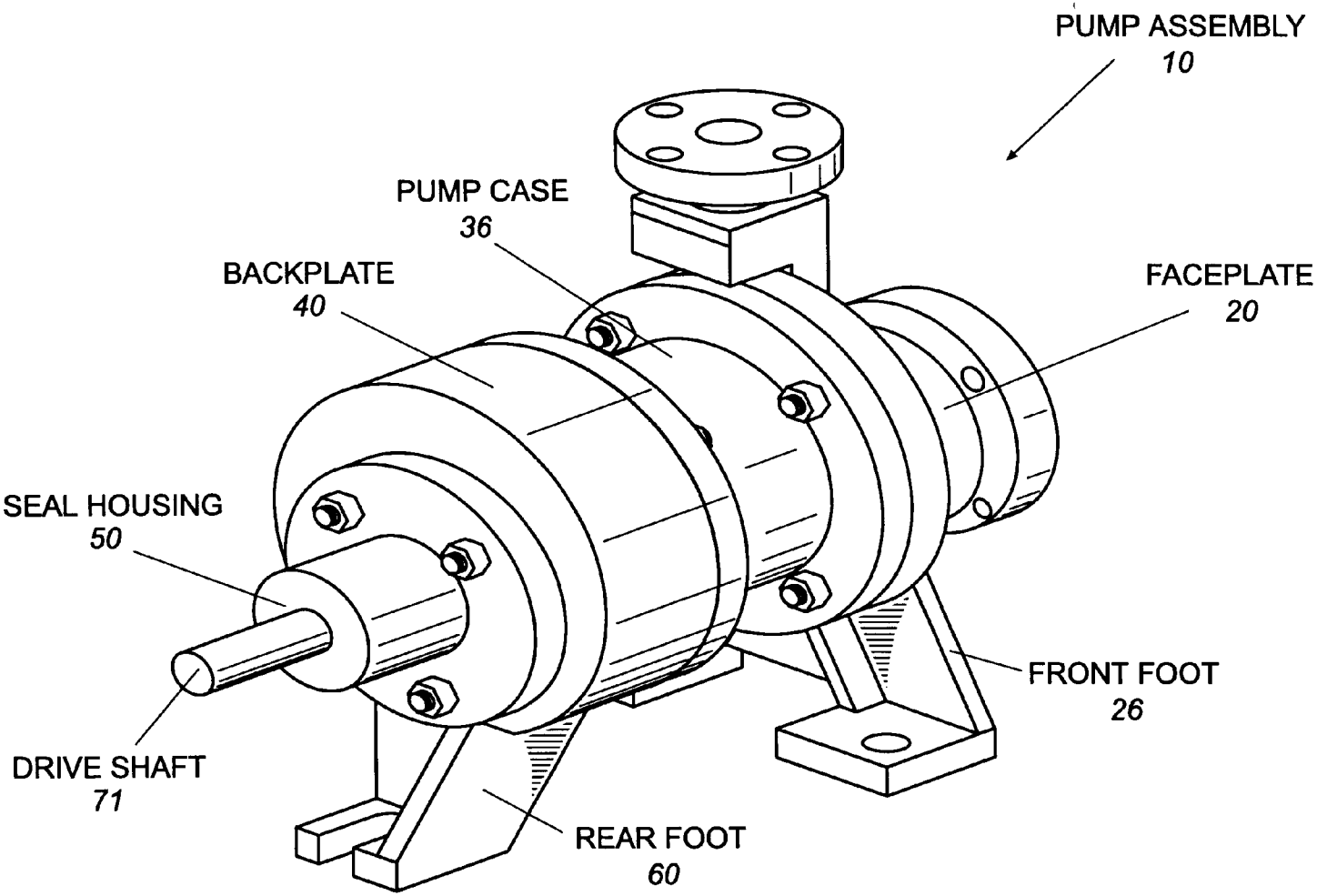
FIG. 1 is a right side perspective view of a pump assembly 10 according to the present invention.

- Overall Configuration and Operation
- The Elements
  - The Faceplate
  - The Pump Case
  - The Backplate
  - The Seal Housing
  - The Shaft Assemblies
- Interaction of the Elements
- Operation of the Apparatus
- The Fluid Path
- Testing Comparisons
- Alternate Configurations
- Materials
- Advantages
- Conclusion Overall Configuration and Operation For purposes of this discussion, the pump assembly 10 will be assumed to have two opposing "ends", a front end into which fluid is drawn (in the normal pumping mode) and a rear end from which rearwardly extends the pump's drive shaft.

Generally described, fluid is pumped by the pump apparatus 10 according to the present invention, such that fluid is delivered from a first, inlet, location at a first pressure to a second, outlet, location at a second fluid pressure which is typically greater that the first fluid pressure. However, as described in detail later, the flow direction can be reversed, which is one of the distinct advantages of the present invention.

The Elements

Generally described, the pump apparatus according to the present invention generally includes the following elements:

a faceplate 20;
a pump case 36;
a backplate 40;
a seal housing 50;
a rear foot 60;
a drive shaft assembly 70 including a drive gear 72;
an idler shaft assembly 80 including an idler gear 82;
a drive shaft front support bearing 73;
an idler shaft front support bearing 83;
a drive shaft rear support bearing 74;
an idler shaft rear support bearing 84.

For purposes of this discussion, the pump assembly 10 will be assumed to have two opposing "ends", a front end into which fluid is drawn (in the normal pumping mode) and a rear end from which rearwardly extends the pump drive shaft 71. However, it should be understood that these are not limiting terms but terms merely used to aid in explanation.

Faceplate 20

Figure 2:
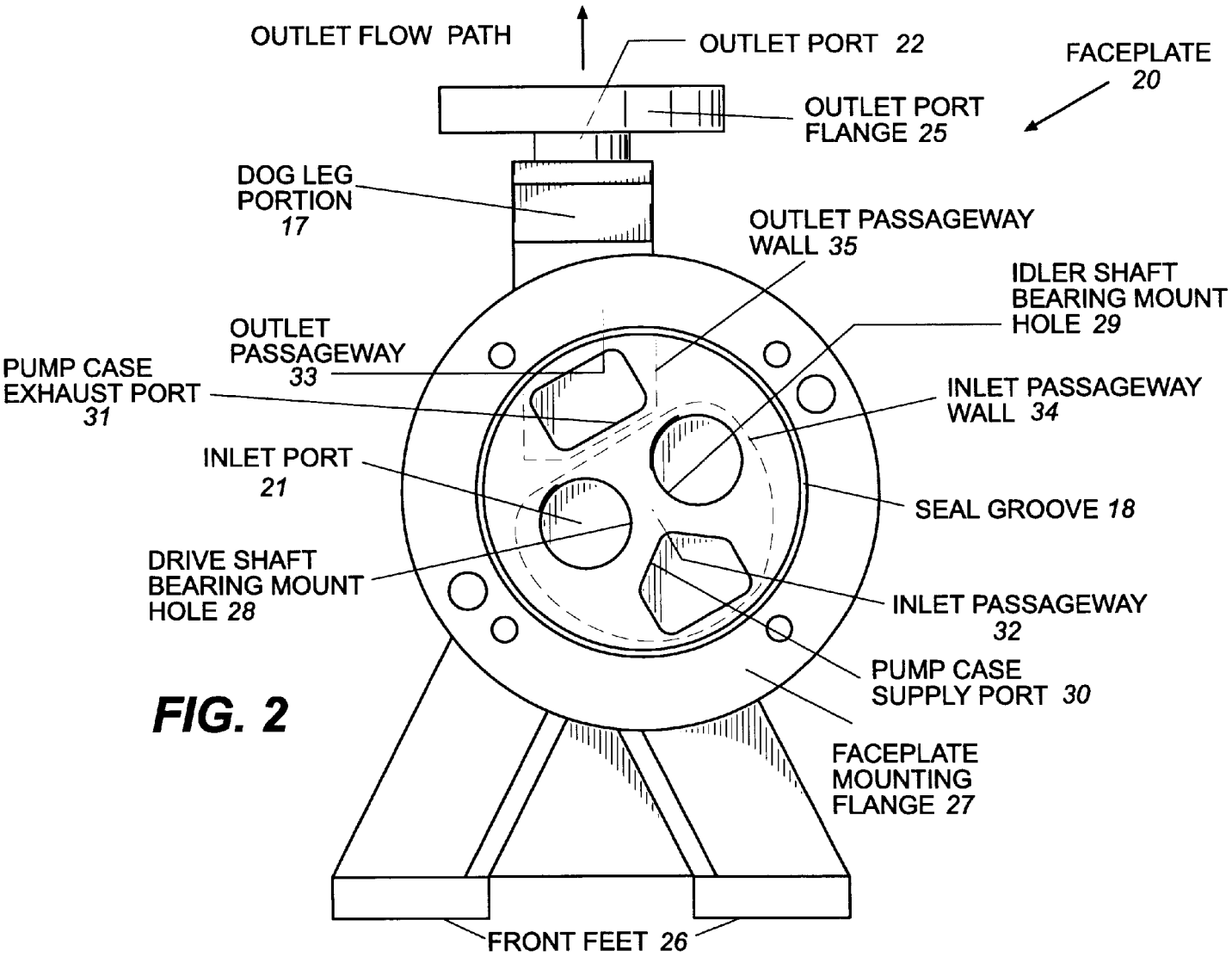
FIG. 2 is an isolated rear elevational view of a faceplate 20 according to the present invention, viewing the faceplate 20 from its "inside" face, that being the face which eventually attaches to a pump case.

Referring particularly to FIG. 2 as well as the other figures, The faceplate 20 includes an outlet port 22, an inlet port flange 24, an outlet port flange 25, a mounting flange 27, and a pair of front feet 26.

The faceplate also defines four ports, an inlet port 21, a pump case supply port 30, a pump case exhaust port 31 and an outlet port 22.

The faceplate 20 defines two fluid passageways, an inlet fluid passageway 32 and an outlet fluid passageway 33. The inlet fluid passageway 32 and the outlet fluid passageway 33 are completely separate from each other, and do not allow for commingling of fluid. During typical operation of the pump assembly 10, the outlet fluid passageway 33 will be at a higher pressure than that of fluid within the inlet fluid passageway 32.

In the case of the inlet fluid passageway 32, fluid enters the inlet port 21 and exits the pump case supply port 30. In the case of the outlet fluid passageway 33, fluid enters from the pump case exhaust port 31 and exits the outlet port 22.

Figure 7:
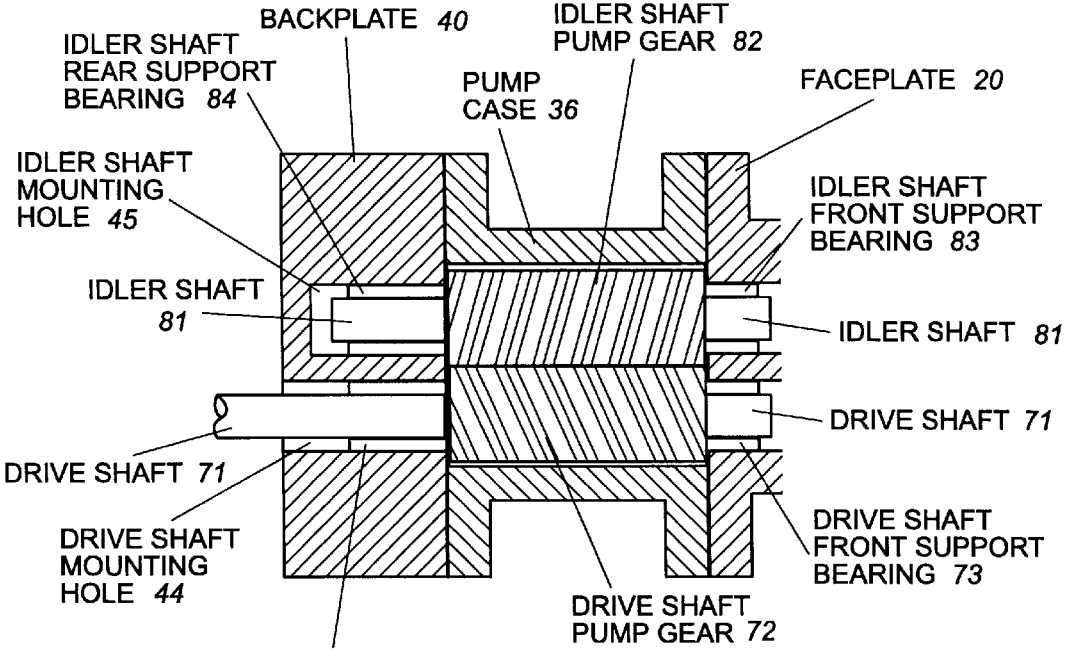
FIG. 7 is a partial cross-sectional view of a portion of the pump apparatus according to the present invention, with the cross-section taken along a plane which includes the central longitudinal axis of both the drive shaft and the idler shaft. The drive shaft, idler shaft, idler pump gear, and drive pump gear are not shown in cross section.

The mounting flange 27 of the faceplate 20 defines a rearwardly-facing planar surface through which extend the pump case supply port 30 and pump case exhaust port 31, as well as two other holes, a drive shaft bearing mount hole 28 and an idler shaft bearing mount hole 29, each of which are configured to support a corresponding sleeve bearing 73, 83, as shown in FIG. 7. As discussed in detail later, these sleeve bearings are configured to support the front ends of the drive shaft 71 and the idler shaft 81, respectively.

Referring now back to FIG. 2, the mounting flange 27 of the faceplate 20 also includes a circular O-ring seal groove 18 which is configured to accept a conventional O-ring seal (not shown). When the faceplate 20 is installed, it is in contact with the front face of a pump case 36, and the O-ring seal provides a seal between the faceplate 20 and the front flange of the pump case 36.

The front feet 26 of the faceplate 20 extend generally downwardly and provide support for the front of the pump assembly 10. As noted elsewhere in this discussion, these feet provide mounting means which satisfy ANSI specifications.

As discussed elsewhere, it may be seen that the faceplate 20 performs a significant and critical function in the operation of the pump assembly 10; it provides for critical guidance of the fluid both as is enters and exits the apparatus, and it likewise provides for support for the drive shaft 71 and the idler shaft 81.

In FIG. 2, the two fluid passageways 32, 33, are shown as being separated from each other and from the atmosphere by fluid cavity barrier walls 34, 35, respectively. It should be understood that although two barrier walls can be used to separate the two fluid cavities from each other, a single barrier wall would be sufficient with respect to separation of the two passageways, and in fact the preferred embodiment contemplates the use of one wall. It should also be understood that the configuration of the inlet passageway wall 34 and the outlet passageway wall 35 shown in the drawings is for the general purposes of understanding and is only by way of example.

The Pump Case 36

The pump case 36 is generally configured to contain the pump gears and to pump fluid therethrough. The pump case 36 when installed is positioned intermediate the faceplate 20 and the backplate 40.

The pump case 36 includes a body portion 37 and two integral flange portions, a front flange portion 39 and a rear flange portion 41.

The front flange portion 39 is configured to be attached to the faceplate 20, and includes a forwardly-facing sealing surface which is configured to contact the rearwardly-facing sealing face defined by the faceplate 20 when attached thereto.

The rear flange portion 41 is configured to be attached to the backplate 40, and includes a rearwardly-facing sealing surface which is configured to contact the forwardly-facing sealing face defined by the backplate 40 when attached thereto.

The body portion 37 of the pump case 36 defines an interior cavity configured to contain the two pump gears 72, 82 attached to their respective shafts 71, 81. This cavity is shaped as known in the art to include space for the two intermeshing pump gears 72, 82, and also to include two regions which supply and receive fluid being pumped by the gears. As discussed in detail later, the region in the pump case cavity which supplies fluid to the pump gears 72, 82 itself receives fluid from the pump case supply port 30 of the faceplate 20. The region in the pump case cavity which receives fluid from the pump gears itself supplies fluid to the faceplate 20 via the faceplate's pump case exhaust port 31.

Figure 6:
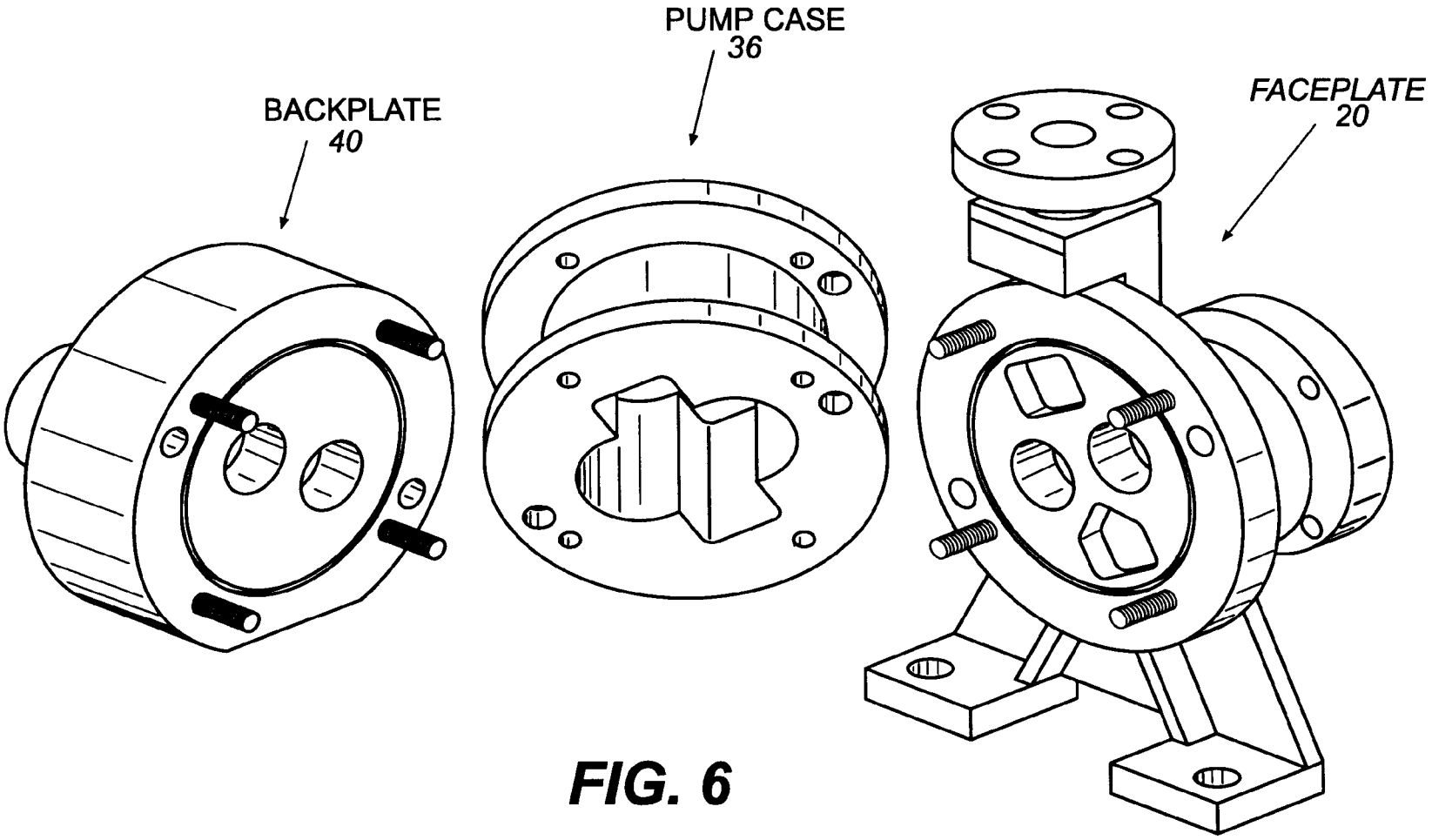
FIG. 6 is a view illustrating three major parts of the apparatus according to the invention in a disassembled, side-by-side manner, those elements including a backplate 40, a pump case 36, and a faceplate 20.

The cavity defined by the pump case 36 is has an irregular transverse cross section which is substantially consistent over the length of the pump case 36. A good view of this cavity is shown in FIG. 6.

As noted elsewhere in this description, although the pump case 36 is shown as a fabricated item, it could be cast and machined without departing from the spirit and scope of the present invention.

Backplate 40

The backplate 40 functions as partial support for both the drive shaft 71 and the idler shaft 81, provides a fluid barrier on one end of the pump case cavity, provides a mounting surface for the seal housing 50, and is attached to the rear foot 60 which extends generally downward therefrom.

When installed, the front face of the backplate 40 is in contact with the pump case 36. To provide fluid sealing therebetween, the front face of the backplate 40 includes a circular O-ring groove (not shown) which contains an O-ring for fluid sealing purposes with the ringlike rearwardly facing face of the rear flange 41 of the pump case.

The front face of the backplate also includes two holes 44, 45 each configured to support a corresponding sleeve bearing 74, 84, respectively, which provide rear support for the drive and idler shafts 71, 81, respectively. A drive shaft mounting hole 44 of the backplate 40 accepts and supports a drive shaft rear support bearing 74, which provides rear support for the drive shaft 71. An idler shaft mounting hole 45 of the backplate 40 accepts and supports a idler shaft rear support bearing 84, which provides rear support for the idler shaft 81.

The idler shaft mounting hole 45 is a "blind" hole which does not extend through the backplate 40. The drive shaft mounting hole 44 is a "through" hole which does extend through the backplate 40.

As noted elsewhere in this description, although the backplate is shown as a fabricated item, it could be cast and then machined without departing from the spirit and scope of the present invention. In fact, the rear foot 60 could also be cast together with the backplate 40.

Seal Housing 50

The seal housing 50 supports a seal or seals intermediate the rotating drive shaft 71 and the body of the pump apparatus 10. The seal housing is attached to the rear side of the backplate 40 and encircles the drive shaft 71.

The seal housing 50 in one preferred version can have a single seal, although multiple seals are contemplated under the present invention.

In one preferred embodiment a mechanical seal as known in the art (not shown) is contemplated within the seal housing, having spring-loaded seal faces which may include a carbon-against-ceramic seal face.

If desired, the seal housing 50 could also have an outboard bearing (not shown).

The Shaft Assemblies

The shaft assemblies 70, 80 are configured to be rotatably mounted within the pump assembly 10 to provide a pumping action upon being driven by an external power source such as an electric motor (not shown).

Figure 8:
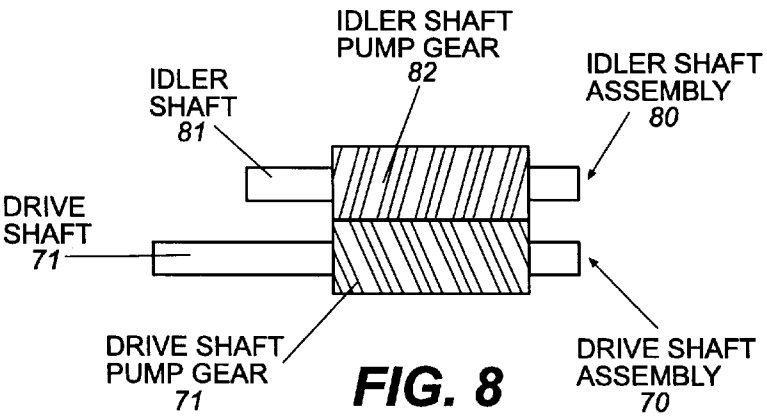
FIG. 8 is an isolated view of a drive shaft assembly 70 and an idler shaft assembly 80, in mutual engagement.

Reference is now made to FIG. 8. FIG. 8 is an isolated view of a drive shaft assembly 70 and an idler shaft assembly 80 in the intermeshing relation in which they exist while assembled within the assembly 10 according to the present invention. The drive shaft assembly 70 includes a drive shaft 71 and a drive shaft pump gear 72 mounted thereon. The idler shaft assembly 80 includes an idler shaft 81 and an idler shaft pump gear 82 rigidly mounted thereto.

The pump gears 72, 82, mounted to their respective shafts 71, 81, mesh as known in the art such that rotation of the drive gear 72 causes rotation of the idler pump gear 82, and such that fluid can be pumped along being trapped between the gear teeth and the case bores and being forced through the outlet passageway 33 by the meshed interface of the gears.

The two shaft assemblies 70, 80 are rotatably mounted within the overall pump assembly by bearing means discussed elsewhere in this application. However, it should be understood that the longitudinal axes of the shafts 71, 81, of the respective shaft assemblies 70, 80 are substantially parallel and rotate in opposite directions during operation of the pump assembly 10.

Reference is now made to FIG. 7. FIG. 7 is a partial cross-sectional view of a portion of the pump apparatus 10, which illustrates the manner in which the drive shaft assembly 70 and the idler shaft assembly 80 are rotatably mounted within the apparatus. The manner in which the assemblies 70, 80, are mounted within bearing is discussed in more detail below.

Although other ANSI-satisfying configurations are contemplated, the drive and idler shafts are 1" diameter shafts inside the pump, with the coupling end (the end which is driven by a motor) being turned down to ⅞" diameter.

Miscellaneous Bearings, Fasteners and Seals

As noted above, sleeve, roller, or other suitable bearings are contemplated for use under the present invention to provide support for the drive shaft assembly 70 and the idler shaft assembly which allow them to rotate as described above. As shown in FIG. 7, the drive shaft 71 is rotatably supported by two bearings, a drive shaft front support bearing 73 and a drive shaft rear support bearing 74. The idler shaft 81 is rotatably supported by an idler shaft front support bearing 83 and an idler shaft rear support bearing 84.

As noted elsewhere, the drive shaft front support bearing 73 and the idler shaft front support bearing are mounted within corresponding mounting holes in the faceplate 20, namely the drive shaft bearing mount hole 28 and the idler shaft bearing mount hole 29. The drive shaft bearing mounting hole 28 is a "through" hole, which extends substantially through the length of the backplate 40. However, the idler shaft bearing mount hole 29 in the backplate is a "blind" hole which does not extend completely through the backplate 40.

Figure 4:
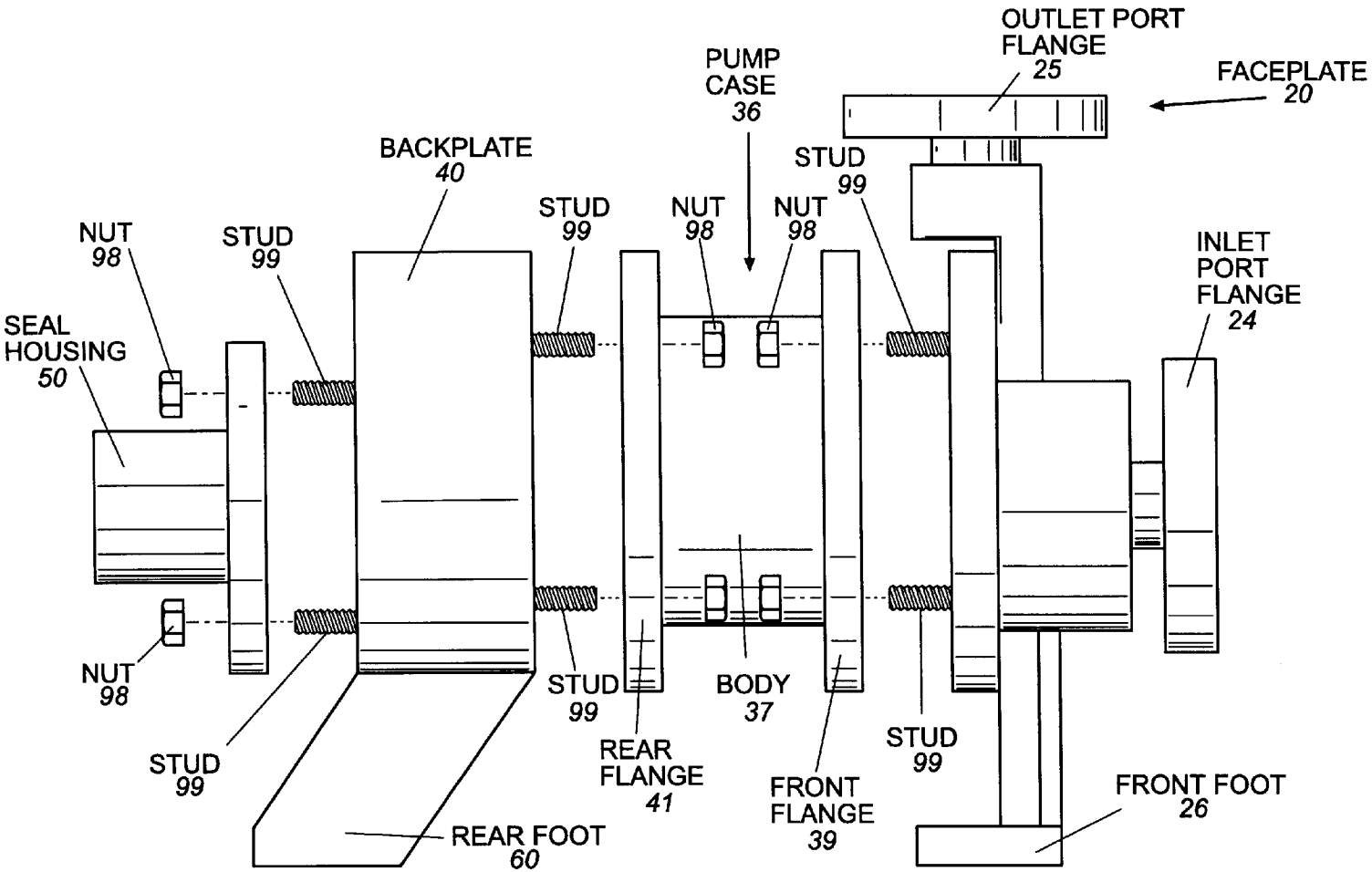
FIG. 4 is an exploded view of that shown in FIG. 3.

As shown in FIG. 4, threaded studs such as 99 (four are used in one embodiment) are used in combination with corresponding threaded nuts such as 98 to attach the faceplate 20 to the pump case 36. As shown in FIG. 4, the threaded studs 99 are threaded into suitably threaded holes in the faceplate 20. Holes suitably spaced in the front flange 39 of the pump case 36 accept the studs 99 such that threaded nuts 98 can be used to fasten the faceplate 20 to the pump case 36.

Four threaded studs such as 99 are used in combination with threaded nuts such as 98 to attach the backplate 40 to the pump case 36. As shown in FIG. 4, the threaded studs 99 are threaded into suitably threaded holes in the backplate 40. Holes suitably spaced in the rear flange 41 of the pump case 36 accept the studs 99 such that threaded nuts such as 98 can be used to fasten the backplate 40 and the pump case 36 together.

Four more threaded studs such as 99 also extend rearwardly of the backplate 40 to allow the fastening of the seal plate 50 to the rear side of the backplate, again with the use of threaded nuts such as 98.

As may be understood, with the pumping of fluid, fluid seals will be required to prevent the pumped fluid from escaping from its desired pumping path and either escaping to atmosphere or fouling the outboard bearing. These seals can take the form of O-ring seals at a stationary interface, such as used intermediate the pump case 36 and the faceplate 20 or intermediate the pump case 36 and the backplate 40. A rotational seal can also be used intermediate the stationary seal housing and the rotating drive shaft 71.

Interaction of the Elements

For purposes of this discussion, the pump assembly 10 will be assumed to have two opposing "ends", a front end into which fluid is drawn (in the normal pumping mode) and a rear end from which rearwardly extends a pump drive shaft 71.

The faceplate 20, pump case 36, backplate 40, seal housing, and rear foot 60 are fastened together by the use of threaded fasteners as noted elsewhere, although other fastening means are contemplated without departing from the spirit and scope of the present invention.

It is critical to understand that the inlet port 21 of the faceplate 20 is in alignment with the drive shaft bearing mounting hole 28, as shown well in FIG. 2. When the overall apparatus is assembled, the faceplate 20 configuration allows for the alignment of the inlet port 21 with the longitudinal axis of the drive shaft 71, which satisfies the ANSI specification for centrifugal pumps. This allows the present invention to provide a gear pump which satisfies an ANSI specification for centrifugal pumps.

Operation of the Apparatus

Operation of the apparatus 10 is relatively straightforward, due to the simple and effective design of the apparatus 10. The drive shaft 71 is driven by an external motor (not shown) through means known in the art including but not limited to pulley/belt, direct gear, or sprocket/chain means. As noted elsewhere in this application, the drive shaft may be driven in opposite directions to cause flow to be opposite directions, and this is an important feature of the present invention.

Upon the driving of the drive shaft, as noted above both the drive shaft pump gear 72 and the idler shaft pump gear 82 are driven together to cause pumping of fluid therebetween, such that fluid enters the inlet port 21 of the pump assembly 10 and exits the outlet port 22 of the pump assembly 10. Reversal of the drive shaft's rotation causes flow reversal.

The Fluid Path

Figure 3:
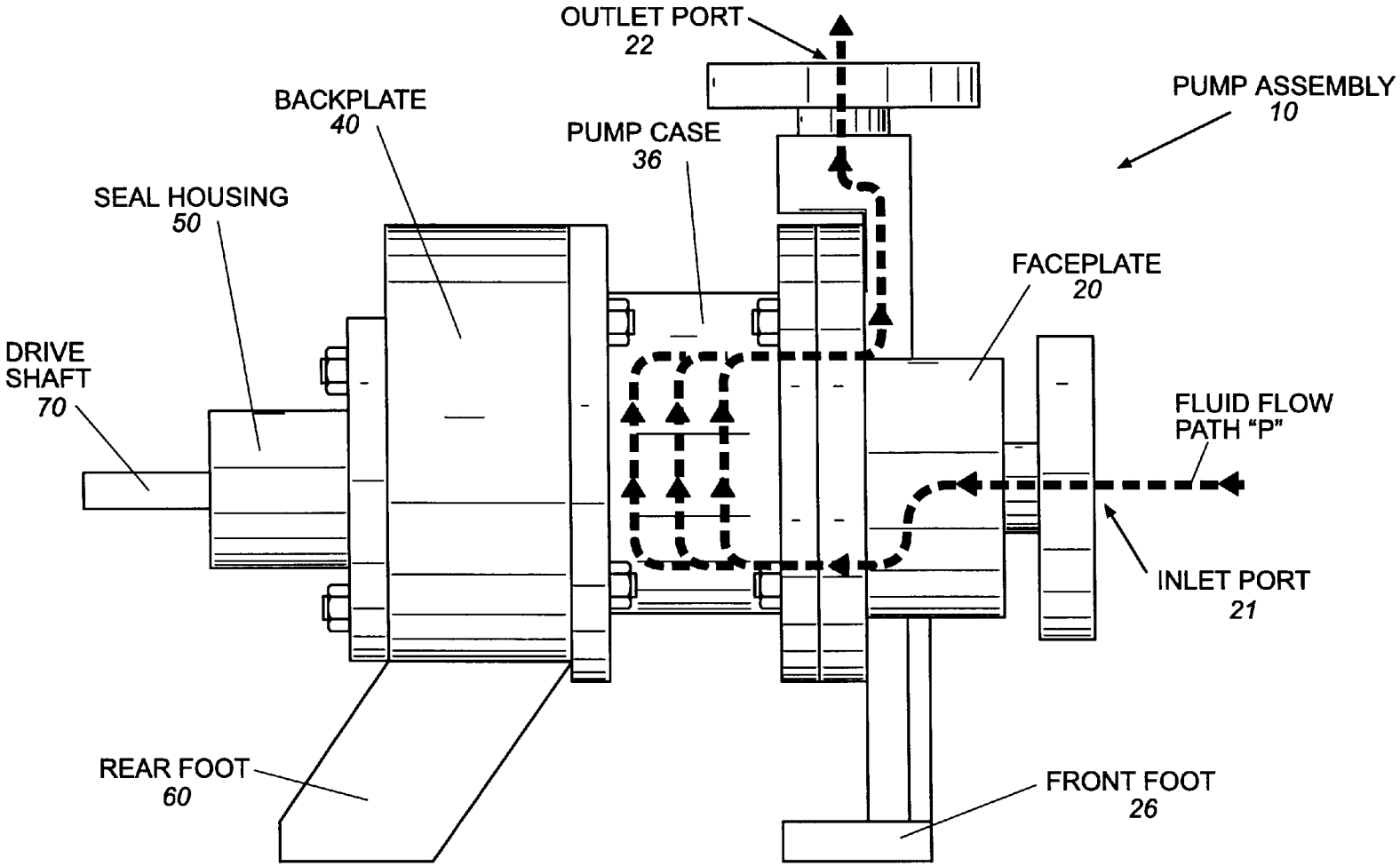
FIG. 3 is a right side elevational view of an assembled pump assembly 10 according to the present invention. Dotted lines illustrate fluid flow through the apparatus.
Figure 5:
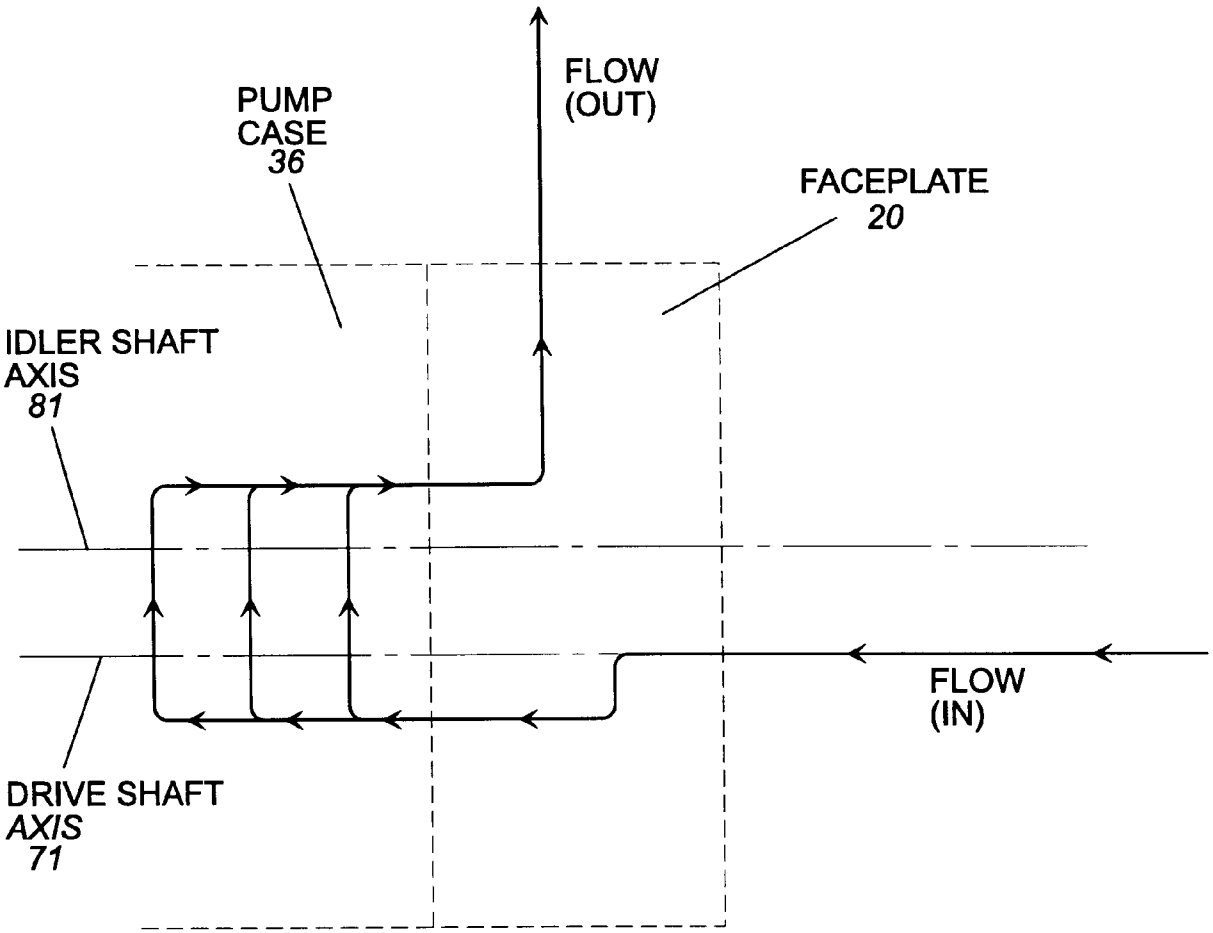
FIG. 5 is an illustrative view of fluid flow through the apparatus according to the present invention.

The fluid path is now described in reference to FIGS. 3, 5, and to a lesser extent the other drawings. As the fluid enters the interior of the faceplate 20 through the inlet port 21, the fluid enters into the first of two fluid passageways defined within the faceplate 20, that being the inlet fluid passageway 32. As noted above, the inlet fluid passageway 32 and the outlet fluid passageway 33 are completely separate from each other. The fluid passes within the inlet fluid passageway 32 out of the pump case supply port 30 of the faceplate and into the internal cavity of the pump case 36. The internal cavity of the pump case cavity 38 is shaped as known in the art to include space for the two intermeshing pump gears and also to include two regions which supply and receive fluid being pumped by the gears. Fluid is pumped by the gears and is then exhausted from the pump case 36 to the pump case exhaust port 31 of the faceplate 20. The fluid then passes along the outlet passageway 33 of the faceplate 20 and upwardly into the "dogleg portion" 17 and out of the outlet port 22.

Efficiency Comparisons

One of the most widely used ANSI centrifugal pumps (1×1½-6) is now compared to an ANSI-Rotary pump (1×1½-GA) according to the present invention based upon available data for conventional centrifugal and gear pumps. Both pumps are rated at approximately 50 gpm flow at 1800 rpm.

For a moderately viscous (400 SSU) fluid viscous drag losses reduce the centrifugal pump efficiency to under 24%, and the pressure is limited to 20 psi at 1800 rpm. In comparison, the gear pump efficiency (see FIG. 9) is higher, at around 30% at 20 psi. Even more significant, the efficiency of the gear pump reaches 65% at 150 psi, which is far above the developed pressure limitation of its centrifugal counterpart.

The minimum required inlet pressure for an gear pump represents a steadily rising curve from low to high flow. A rotary pump is not as sensitive to inlet piping configuration, and maintains low and predictable suction pressure requirements. ANSI centrifugal pumps, on the other hand, are known to be very sensitive to the inlet piping. This issue with centrifugal pumps is a real problem with many users who realize and acknowledge their inlet piping being far from the required by the centrifugal pumps, but cannot afford expensive piping modifications. However, the gear pumps are not as sensitive to inlet piping—a simple replacement of a problem centrifugal pump by an gear pump offers a quick, simple and reliable solution in a cost effective way.

A typical industrial practice is to add at least 35% more NPSH (net positive suction head) on top of the published 3%—head-drop curves. Furthermore, published values for centrifugal ANSI pumps show only a so-called 3%—head-drop NPSH, i.e., a NPSH value at which a pump is in full cavitation, and the head drops by 3%. The maximum damage to the pump actually occurs earlier at higher value of the NPSH. In centrifugal pumps, an incipient cavitation starts significantly before the pump is fully blocked with vapor created at complete cavitation. The "R-value" (ratio of NPSH incipient to NPSH 3%) can be 3–4 or even higher. At higher than BEP (best efficiency) point, centrifugal pumps "stonewall," i.e., rapidly increase the required NPSH, which often exceeds plant available NPSHA and limits the flow capability.

At low flows, an inlet recirculation onsets at the eye of a centrifugal pump, causing high vibrations, seals leakage, and mechanical damage to bearings. In addition, an even pressure distribution around the volute causes a radial thrust to become several times that of the BEP flow. All of these factors deem ANSI centrifugal pumps limited to rather narrow range of flows, close to BEP. For these reasons, many users are looking at the ANSI-Rotary pumps as a solution to hydraulic-related problems at their plants.

Under high viscosity applications (over 400–2000 ssu and higher), the efficiency curve of a centrifugal pump is almost completely disappeared, while a gear pump is still at high efficiency. This ability of gear pumps to handle highly viscous fluids just a easy as standard applications, has traditionally positioned them invaluable for mixing, blending, and other highly viscous plant processing application, while centrifugal pumps are completely unsuitable for such applications.

In very low viscosity applications, at higher pressures, gear pumps maintain approximately the same efficiency as centrifugal pumps. However, at very low pressures centrifugal pumps have somewhat higher efficiencies. This is the reason why centrifugal pumps found a wider use in such applications as water and like viscosities, although rotary pumps with minor design alterations are made and applied to viscosities below 1 cSt, such as naphtha and similar liquids, particularly at high pressures.

Alternate Configurations

As may be understood, alternate configurations are possible to provide without departing from the spirit and scope of the present invention. For example, instead of using "fabricated" pump components by the use of welding, grinding, and otherwise forming performed metal materials, casting may be used. The use of casting may be understood to be advantageous in a higher-production environment. As may be understood, some machining will be still required in certain locations where tolerances so require.

Furthermore, some of the elements which as separate in the embodiments shown in the figures can be combined with other elements when casting is used in a higher production volume application.

As an example, in the embodiment shown in the figures, the backplate 40 is just round bar stock, approximately 7" in diameter and about 2½" thick. However, in an alternate production-type configuration, such a backplate can be provided by a casting. Furthermore, the backplate may be cast together with the back foot, which is shown in the drawings as a separate element and is bolted to the back plate 40.

The faceplate 20, pump case 36 and seal housing 50 can also be cast if so desired and same is contemplated in a production environment. The seal housing will still be separate even in the new casting configuration.

Materials

Various materials may be used for the various housings or other elements within the apparatus. For example, ASTM A395 N Ductile Iron maybe used in a cast configuration. AISI 316 stainless steel may be used from bar stock form. ASTM A 743-808, type CF-8M may be used in cast form. Cast steel, grade ASTM 216-77 grade WCB may likewise be used in a cast form. The shafts may be used carbon steel or stainless steel. The gears may be made of stainless steel, grade 17-4 PH.

Advantages

Therefore it may be seen that the present invention overcomes deficiencies in the prior art by providing a centrifugal pump which conforms to ANSI standards, in that it fits exactly to the same envelope as centrifugal ANSI pump. Replacement is easy and straightforward.

The pump is likewise bi-directional, or "reversible" by simply reversing the direction of motor rotation, the ANSI-Rotary pump will pump in reverse, which can be advantageous in many processes. In comparison, a centrifugal pump can only pump in one direction. In some installations, two centrifugal pumps are used: one for loading and another for unloading, including complex piping, valuing, and auxiliaries. Just one ANSI-Rotary pump will do the job. The pump according to the present invention has low flow stability, and is efficient (20–50% better than centrifugal for most typical pumped fluids). The pump is also self priming, in that it can lift can lift 15–20 feet. In contrast, a standard ANSI centrifugal pump cannot lift liquid. The pump according to the present invention low radial thrust characteristics, and handles viscous fluids well. Above approximately 300–1000 ssu (such as DTE light oils, as an example), a centrifugal pump simply cannot be used, as viscous drag reduces efficiency to nearly zero. In contrast the pump according to the present invention continues to pump at high efficiency. The present pump also can pump fluid within a high range of pressure values. As an example, a 1×1½-6 centrifugal pump can only produce approximately 20 psi system pressure at 1800 rpm. The same ANSI dimensional Rotary pump works at pressures to 150 psi and higher.

Such a pump configuration provides an easy way to retrofit problem applications, an attractive cost effective solution for the new installations, and ensures dimensional interchangeability of the pump, for ease of replacement, spare parts inventory, and standardization of maintenance techniques It may be understood that the configuration of the faceplate allows for replacement of the either of the shafts without disconnecting or otherwise disturbing the supply or return piping attached to the pump assembly 10.

Conclusion

With a renewed attention to pump reliability, cost, performance, and inventory logistics, many plants are beginning to look at an attractive alternative to ANSI centrifugal pumps: ANSI-Gear pumps, with higher efficiencies, metering and self-priming capabilities, and several other factors, make them excellent choices for today's demanding user applications. The present invention provides such an ANSI-Gear pump which can satisfy the above and other needs.

While this invention has been described in specific detail with reference to the disclosed embodiments, it will be understood that many variations and modifications may be effected within the spirit and scope of the invention as described in the appended claims.

What is claimed is:

1. A gear pump configured for operation within a predetermined operating environment, said gear pump comprising:

a gear pump inlet port lying along a gear pump inlet port axis;

a gear pump outlet port lying along a gear pump outlet port axis, said outlet port axis being substantially perpendicular to said inlet port axis;

a pump case defining an interior pump cavity and also including a pump case inlet port and a pump case outlet port;

a drive shaft having a drive shaft pump gear mounted thereon, said drive shaft having a longitudinal axis configured to pass through said inlet port substantially parallel to said inlet port axis;

an idler shaft having an idler shaft pump gear mounted thereon, said idler shaft pump gear configured to fit along with said drive shaft pump gear within said interior pump cavity and interact such that rotation of both tends to pump fluid from said pump cavity inlet port to said pump cavity outlet port; and a single-piece manifold configured to be attached as a unit to said pump case, said manifold defining an inlet passageway and an outlet passageway, said inlet passageway configured to provide fluid communication from said gear pump inlet port to said pump case inlet port, and said outlet passageway configured to provide fluid communication from said gear pump outlet port to said pump case outlet port, such that rotation of said drive shaft causes said drive shaft pump gear and said idler shaft pump gear to pump fluid from said gear pump inlet port to said gear pump outlet port such that fluid flows along the axis of said drive shaft when entering said gear pump inlet port.

2. The gear pump as claimed in claim 1, wherein said inlet port is defined by an inlet port portion including a mounting flange configured for accepting external fluid plumbing thereto, said mounting flange including a mounting surface which is substantially perpendicular to said inlet port axis.

3. The gear pump as claimed in claim 1, wherein said drive shaft and said idler shaft are substantially parallel.

4. The gear pump as claimed in claim 1, wherein said single-piece manifold is cast.

5. The gear pump as claimed in claim 1, wherein said single-piece manifold is fabricated from an assembly of elements.

6. The gear pump as claimed in claim 1, wherein said outlet port is defined by an outlet port portion including a mounting flange configured for accepting external fluid plumbing thereto, said mounting flange including a mounting surface which is substantially perpendicular to said inlet port axis.

7. The gear pump as claimed in claim 6, wherein said drive shaft and said idler shaft are substantially parallel.

8. The gear pump as claimed in claim 6, wherein said drive shaft and said idler shaft are substantially parallel.

9. The gear pump as claimed in claim 8, wherein said inlet port is defined by an inlet port portion including a mounting flange configured for accepting external fluid plumbing thereto, said mounting flange including a mounting surface which is substantially perpendicular to said inlet port axis.

10. The gear pump as claimed in claim 9, wherein said outlet port is defined by an outlet port portion including a mounting flange configured for accepting external fluid plumbing thereto, said mounting flange including a mounting surface which is substantially perpendicular to said inlet port axis.

11. A gear pump configured for operation within a predetermined operating environment, said gear pump comprising:

a gear pump inlet port lying along a gear pump inlet port axis;

a gear pump outlet port lying along a gear pump outlet port axis, said outlet port axis substantially perpendicular to said inlet port axis;

a pump case defining an interior pump cavity and also including a pump case inlet port and a pump case outlet port;

a drive shaft having a drive shaft pump gear mounted thereon, said drive shaft having a longitudinal axis configured to pass through said inlet port substantially parallel to said inlet port axis;

an idler shaft having an idler shaft pump gear mounted thereon, said idler shaft pump gear configured to fit along with said drive shaft pump gear within said interior pump cavity and interact such that rotation of both tends to pump fluid from said pump cavity inlet port to said pump cavity outlet port;

a single-piece manifold configured to be attached as a unit relative to one end of said pump case, said manifold defining an inlet passageway and an outlet passageway, said inlet passageway configured to provide fluid communication from said gear pump inlet port to said pump case inlet port, and said outlet passageway configured to provide fluid communication from said gear pump outlet port to said pump case outlet port; said manifold including a wall portion including a bearing support for supporting at least one bearing, said wall portion partially defining said inlet passageway;

a backplate configured to be attached relative to the other end of said pump case, said backplate including a bearing support for supporting at least one bearing;

a first bearing intermediate said manifold bearing support and one of said drive and idler shafts for supporting one end of one of said shafts; and a second bearing intermediate said backplate bearing support and said one of said drive and idler shafts for supporting the other end of said one of said shafts, such that rotation of said drive shaft causes said drive shaft pump gear and said idler shaft pump gear to pump fluid from said gear pump inlet port to said gear pump outlet port such that fluid flows along the axis of said drive shaft when entering said gear pump inlet port.

12. The gear pump as claimed in claim 11, wherein said manifold bearing support is a bearing-sized hole defined in a wall of said manifold, said wall separating said interior pump cavity of said pump case and one of said passageways of said manifold if not for the existence of said bearing and said shaft therein.

13. The gear pump as claimed in claim 11, wherein said manifold bearing support is a bearing-sized hole defined in a wall of said manifold, said wall separating said interior pump cavity of said pump case and said inlet passageway of said manifold if not for the existence of said bearing and said shaft therein.

14. The gear pump as claimed in claim 11, wherein said manifold further comprises a foot.

15. The gear pump as claimed in claim 11, wherein said manifold further comprises a second manifold bearing support configured to support a third bearing, and further comprising a third bearing intermediate said second manifold bearing support and the other of said drive and idler shafts for supporting one end of said other of said shafts, such that said manifold at least partially provides load support for each of said shafts.

16. The gear pump as claimed in claim 15, wherein said first and second manifold bearing supports are bearing-sized holes defined in a wall of said manifold, said wall separating said interior pump cavity of said pump case and one of said passageways of said manifold if not for the existence of said bearings and said shafts therein.

* * * * *

UNITED STATES PATENT AND TRADEMARK OFFICE

CERTIFICATE OF CORRECTION

PATENT NO. : 6,152,719
DATED : November 28, 2000
INVENTOR(S) : Nelik et al.

It is certified that error appears in the above-identified patent and that said Letters Patent is hereby corrected as shown below:

In the Abstract

*(Additions in Underline, Deletions in Brackets)*

The present invention overcomes deficiencies in the prior art by providing a gear [centrifugal] pump which conforms to ANSI standards, is reversible, is efficient, is self priming, has low flow stability and low radial thrust characteristics, handles viscous fluids well, and can pump fluid within a high range of pressure values. Such a pump configuration provides an easy way to retrofit problem applications, an attractive cost effective solution for the new installations, and ensures dimensional interchangeability of the pump, for ease of replacement, spare parts inventory, and standardization of maintenance techniques.

UNITED STATES PATENT AND TRADEMARK OFFICE

CERTIFICATE OF CORRECTION

PATENT NO. : 6,152,719
DATED : November 28, 2000
INVENTOR(S) : Nelik et al.

It is certified that error appears in the above-identified patent and that said Letters Patent is hereby corrected as shown below:

In the Summary of the Invention (First Paragraph)

*(Additions in Underline, Deletions in Brackets)*

The present invention overcomes deficiencies in the prior art by providing a gear [centrifugal] pump which conforms to ANSI standards, is reversible, has low flow stability, is efficient, is self priming, has low flow stability, low radial thrust characteristics, handles viscous fluids well, and can pump fluid within a high range of pressure values. Such a pump configuration provides an easy way to retrofit problem applications, an attractive cost effective solution for the new installations, and ensures dimensional interchangeability of the pump, for ease of replacement, spare parts inventory, and standardization of maintenance techniques.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*